US005931150A

United States Patent [19]

Bowen et al.

[11] Patent Number: 5,931,150

[45] Date of Patent: Aug. 3, 1999

[54] STOVE KNOB ASSEMBLY

[76] Inventors: Cynthia L. Bowen; Walter Lee Bowen, both of 129 Midtown La., Washington, N.C. 27889

[21] Appl. No.: 09/159,268

[22] Filed: Sep. 23, 1998

[51] Int. Cl.[6] ..... F24C 3/12

[52] U.S. Cl. ..... 126/42; 126/39 N; 251/90

[58] Field of Search ..... 126/42, 39 R, 126/39 N, 214 R; 431/153; 251/90, 93, 96

[56] References Cited

U.S. PATENT DOCUMENTS

| | | | |
|---|---|---|---|
| D. 346,529 | 5/1994 | Honaker . | |
| 3,789,823 | 2/1974 | Doskocil . | |
| 4,300,525 | 11/1981 | Delgado et al. | 126/42 |
| 4,625,708 | 12/1986 | Beall . | |
| 5,203,597 | 4/1993 | Wheelock . | |
| 5,363,720 | 11/1994 | Sanchez . | |
| 5,438,974 | 8/1995 | Maldonadol . | |
| 5,560,233 | 10/1996 | Watkins | 251/90 |
| 5,615,667 | 4/1997 | Seeley et al. . | |
| 5,771,878 | 6/1998 | Lewis | 126/42 |

*Primary Examiner*—James C. Yeung
*Attorney, Agent, or Firm*—Rhodes, Coats, & Bennett, LLP

[57] ABSTRACT

A removable interlock spacer is disposed between the rear face of a control knob and the face of a control panel of a cooking device, such as a stove or a barbecue grill, to prevent the control knob from being pushed in far enough to activate the associated cooking element(s). The push-in-and-turn type switches used in such devices require that the control knob be pushed in before the switch can be moved from its off position. The interlock spacer is of sufficient thickness to prevent the control knob from being pushed in far enough to allow the switch to be moved from its off position. Thus, the cooking element cannot be activated with the interlock spacer in position. When the cooking device is to be used, the interlock spacer may be removed and the switch will operate normally. Thereafter, when cooking is complete, the interlock spacer is re-installed so that young children and the like will not inadvertently create a hazard to themselves and others.

23 Claims, 4 Drawing Sheets

STOVE KNOB ASSEMBLY

FIELD OF THE INVENTION

The present invention relates to the field of cooking devices, and more particularly to a knob assembly for preventing children from activating cooking elements while playing.

BACKGROUND OF THE INVENTION

Young children often play with exposed controls of cooking devices, such as stoves, barbeque grills, and the like. They can accidentally turn on gas-fired or electrically-heated elements while playing with the controls, thereby creating a danger to themselves and others from explosion, fire, burns, gas, and the like. As such, there has been a long-recognized need for devices which protect children from the dangers associated with improper contact with controls for cooking devices.

A number of designs have been proposed to address this problem. One example is shown in U.S. Pat. No. 5,438,974 to Maldonado. Maldonado shows a generally planar shield which is attached to a stove and substantially covers the control panel of the stove. The intent of the Maldonado device is to allow access to the control knobs of the stove only from above, thereby preventing the inadvertent access by young children from below. A similar approach is shown in U.S. Pat. No. 4,645,708 to Beall. Instead of covering the entire control panel, an alternative approach is disclosed in U.S. Pat. No. 5,363,720 to Sanchez which utilizes individual safety caps for each stove knob. However, the Sanchez device is rather bulky and difficult to apply and to remove. While differing in their details, the methods described above all rely on some form of external protection to prevent access to the control knobs. However, this approach has proven unsatisfactory due to the bulk and the complexity of the equipment required.

Thus, there remains a need for a more satisfactory knob assembly which includes a simple-to-use safety interlock device.

SUMMARY OF THE INVENTION

In the present invention, a removable interlock spacer is disposed between the rear face of the control knob and the face of the control panel which prevents the control knob from being pushed in far enough for the cooking element to be activated. In general, cooking devices, such as stoves and barbecue grills, use push-in-and-turn type switches for controlling their cooking elements. These switches require that the control knob, or more accurately, the associated switch post, be pushed in before the switch can be moved from its off position, thereby activating the associated cooking element.

The interlock spacer of the present invention is disposed between the rear face of the control knob and the face of the control panel. The interlock spacer is of sufficient thickness to prevent the control knob from being pushed in far enough to allow the switch to be moved from its off position. Thus, the cooking element cannot be activated with the interlock spacer in the locked position. When the cooking device is to be used, the interlock spacer may be removed and the switch will operate normally. Thereafter, when cooking is complete, the interlock spacer is re-installed so that young children and the like will not inadvertently create a hazard to themselves and others.

The interlock spacer may take any one of a wide variety of shapes, but a generally disc shaped configuration is preferred. The center of the interlock spacer should include a post hole for fitting around the switch post. In addition, there is preferably a slot running from the post hole to the side edge of interlock spacer which allows the interlock spacer to be installed and removed over the switch post without the control knob having to be removed. The interlock spacer is preferably transparent so as to minimize aesthetic impact and to avoid the attention of young children and preferably has a thickness in the range of approximately 0.1" to approximately 0.3". This interlock spacer is simple to manufacture, simple to use, does not require the use of any bulky elements or alteration to existing stoves, and provides a safeguard against injury to young children.

DETAILED DESCRIPTION OF THE INVENTION

Figure 1:
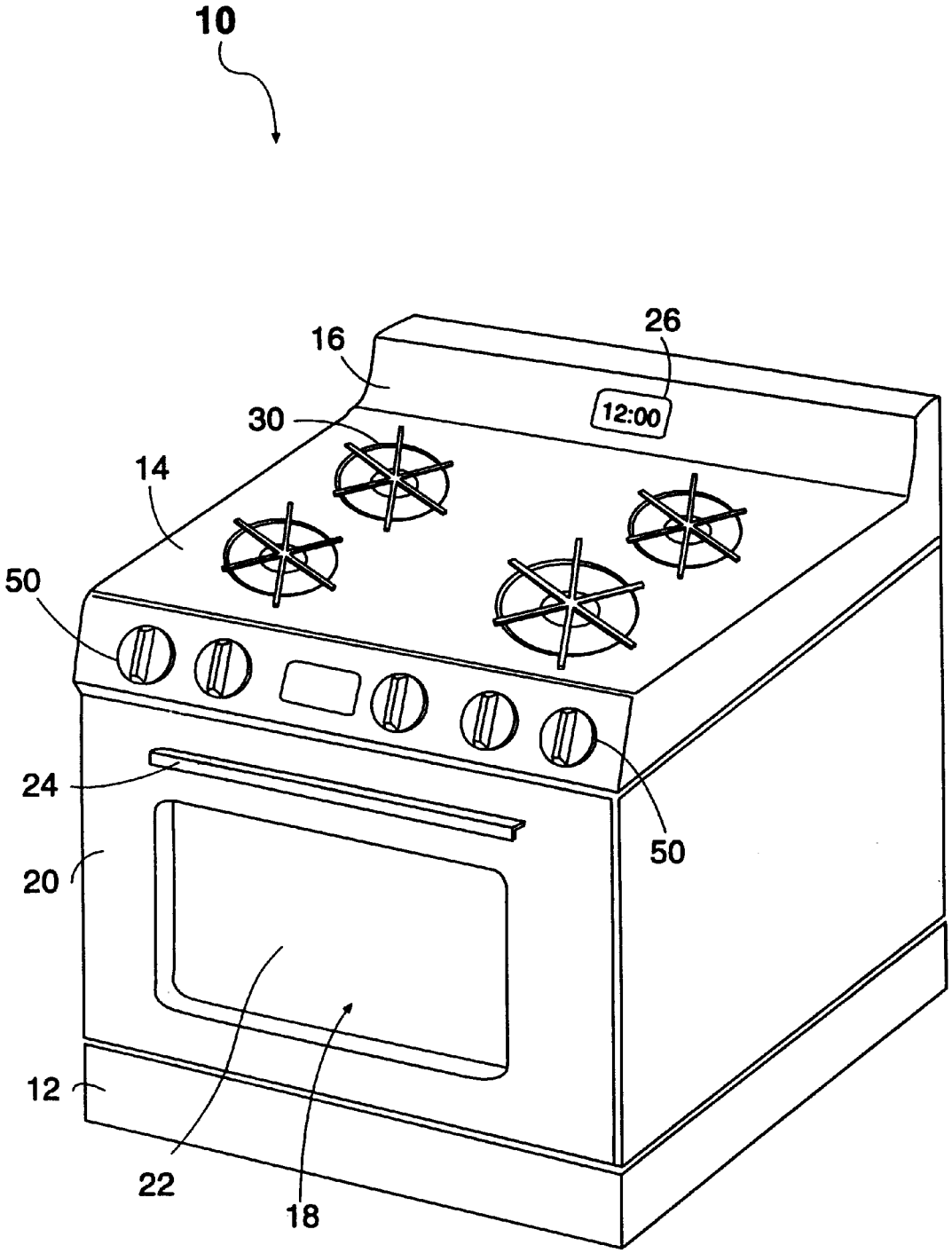
FIG. 1 is a perspective view of a typical stove of the prior art.

A modern stove 10 is generally rectangular in shape, having an oven 18 in a lower portion and a plurality of stovetop cooking elements 30 arrayed on its top surface 14. The oven 18 may be accessed via its door 20 by pulling on the appropriate handle 24 and viewed via a door window 22. Along the back edge of the top surface 14 is typically a splatter shield 16, which may include a clock 26. The cooking elements 30 within the oven 18 and the stovetop elements 30 may be electrically powered or may be gas fired, or a combination of both. Further, as is known in the art, the oven 18 may include microwave radiation sources for additional or alternative methods of cooking. The details of the construction and operation of the stove 10, and variations thereof, are well known in the art and are not discussed further herein except as to assist in understanding the present invention.

The stove 10 typically includes a control panel 42 arrayed either on its front 12 or along its top 14, which may be angled or coplanar with the associated surface 12,14. The control panel 42 includes a plurality of control knobs 50 for activating and/or adjusting the cooking elements 30. These control knobs 50 typically have a generally round base portion 56, having a tongue portion 54 extending out normally thereto. The rear face 52 of the base portion 56 is typically flat. The control knobs 50 are attached to the external end portion 62 of switch posts 64, preferably in a keyed arrangement. A switch 60 is disposed at the opposite end of the switch post 64 and is typically attached to the control panel 42 via brackets or the like. By pressing and turning the switch post 64, an operator is able to make the necessary adjustments to the cooking elements 30 via the switch 60. Because the switches 60 are typically disposed behind the control panel 42 for safety reasons, a hole is typically provided in the control panel 42 for the switch post 64 to extend out of.

To operate stoves 10 using prior art knob assemblies, a user would turn control knobs 50 on the control panel 42 associated with the stove 10. In order to be able to turn the control knobs 50 from an "off" position, it is necessary to first push the control knob 50 inwardly from an "out" position to an "in" position, before turning the control knob 50. Thus, it was necessary for the user to push in on the control knob 50 before it could be turned. By pushing in and twisting the control knob 50, the user was able to turn on the associated switch 60 and therefore activate the associated cooking element(s) 30.

Figure 2:
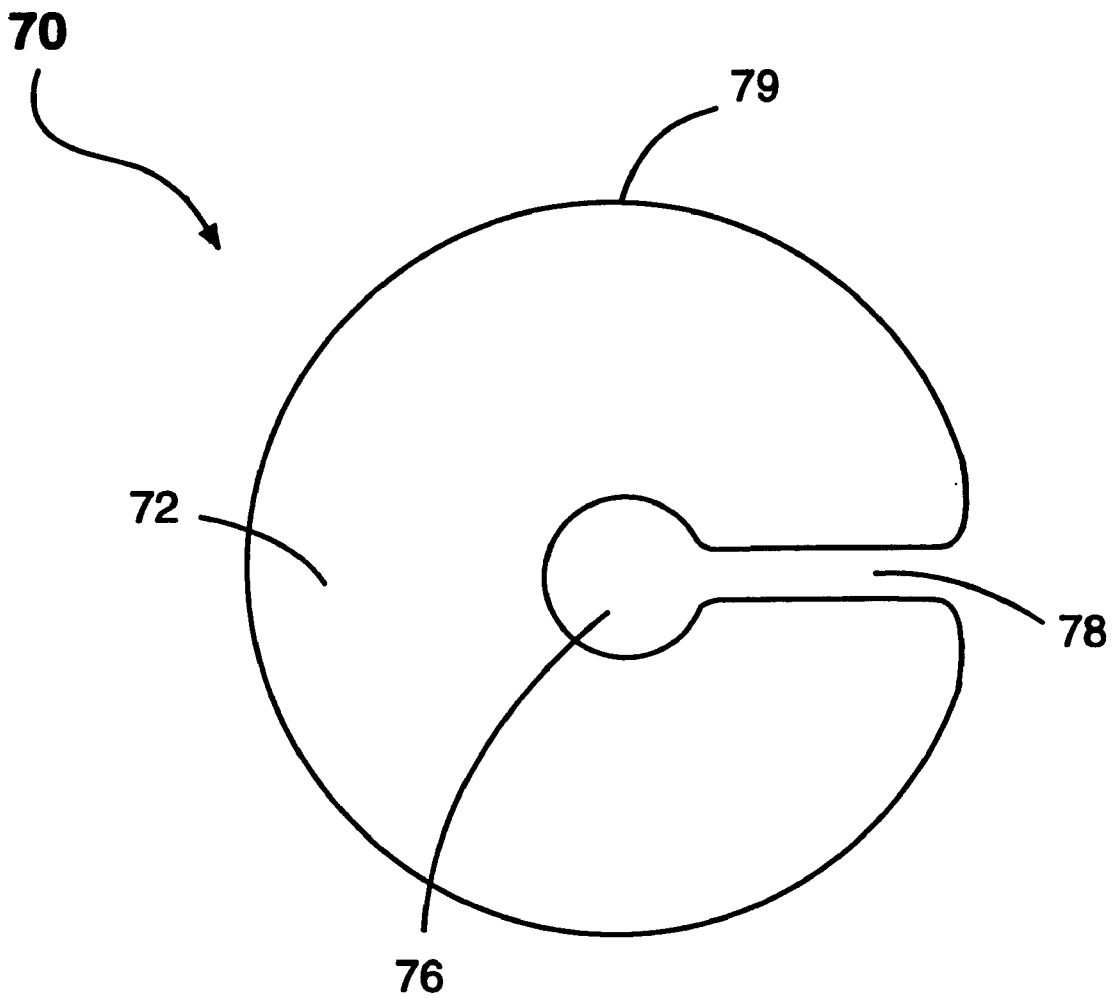
FIG. 2 is a top view of one embodiment of the interlock spacer of the present invention.
Figure 3:
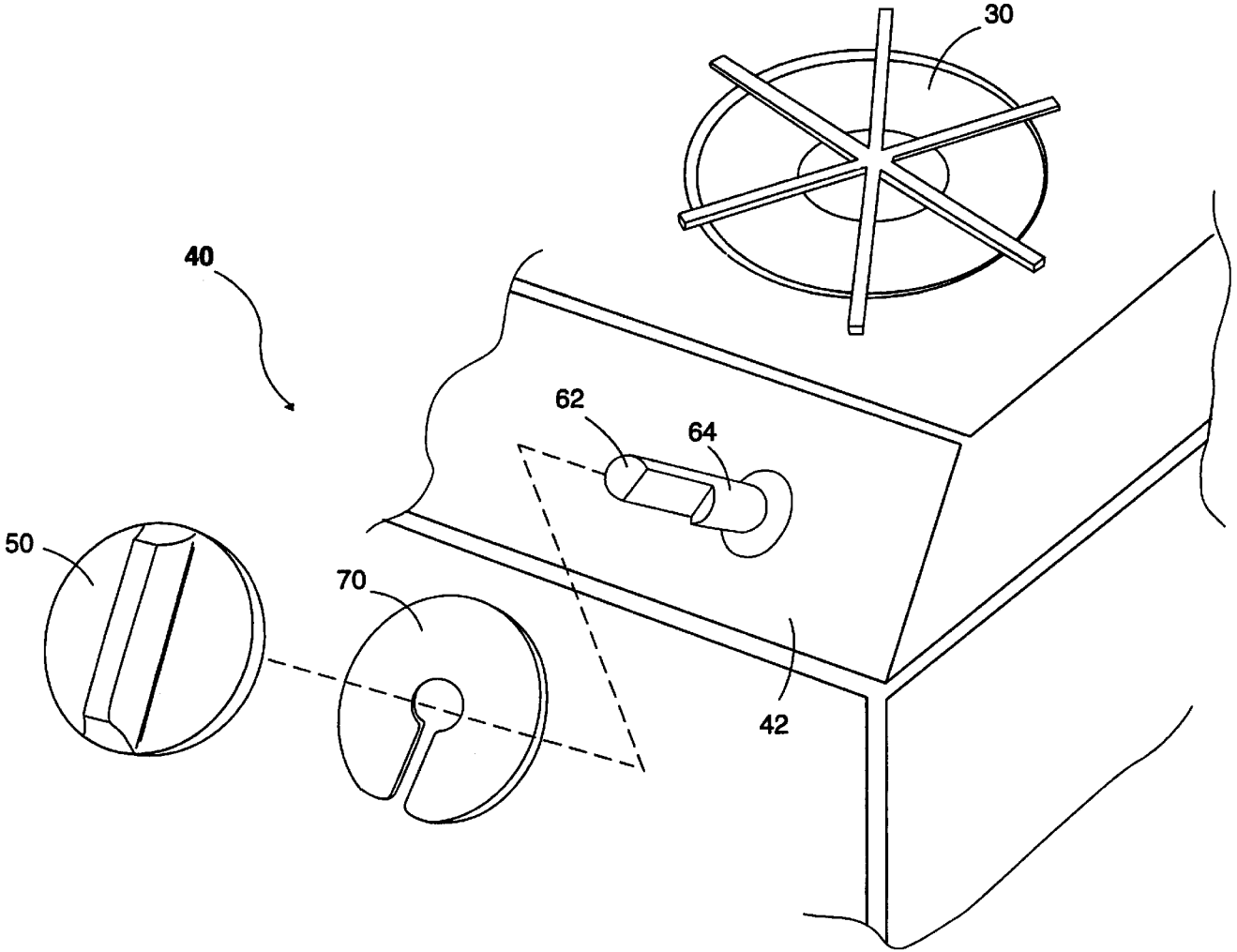
FIG. 3 is perspective partial exploded view of one embodiment of the knob assembly of the present invention.

The knob assembly 40 of the present invention is typically coupled to the control panel 42 as in the prior art and includes the control knob 50 and switches 60 described above. In addition, the knob assembly 40 includes an interlock spacer 70. In one preferred embodiment, shown in FIG. 2, the interlock spacer 70 is generally disk shaped, having a top surface 72 and a bottom surface 74 and a circumferential edge 79. The center of the spacer includes a post hole 76. A slot 78 connects the post hole 76 to the circumferential edge 79 of the interlock spacer 70. In preferred embodiments, the interlock spacer 70 is made from a suitably hard plastic material, such as 0.20" thick vinyl, and is preferably transparent. Of course, the interlock spacer 70 may be made from other thickness or types of materials. It is believed that a thickness in the range of approximately 0.1" to 0.3" would be most appropriate, as this range of thickness corresponds to the typical inward throws required to activate the most common push-in-and-turn switches 60 used in stoves 10.

Figure 4:
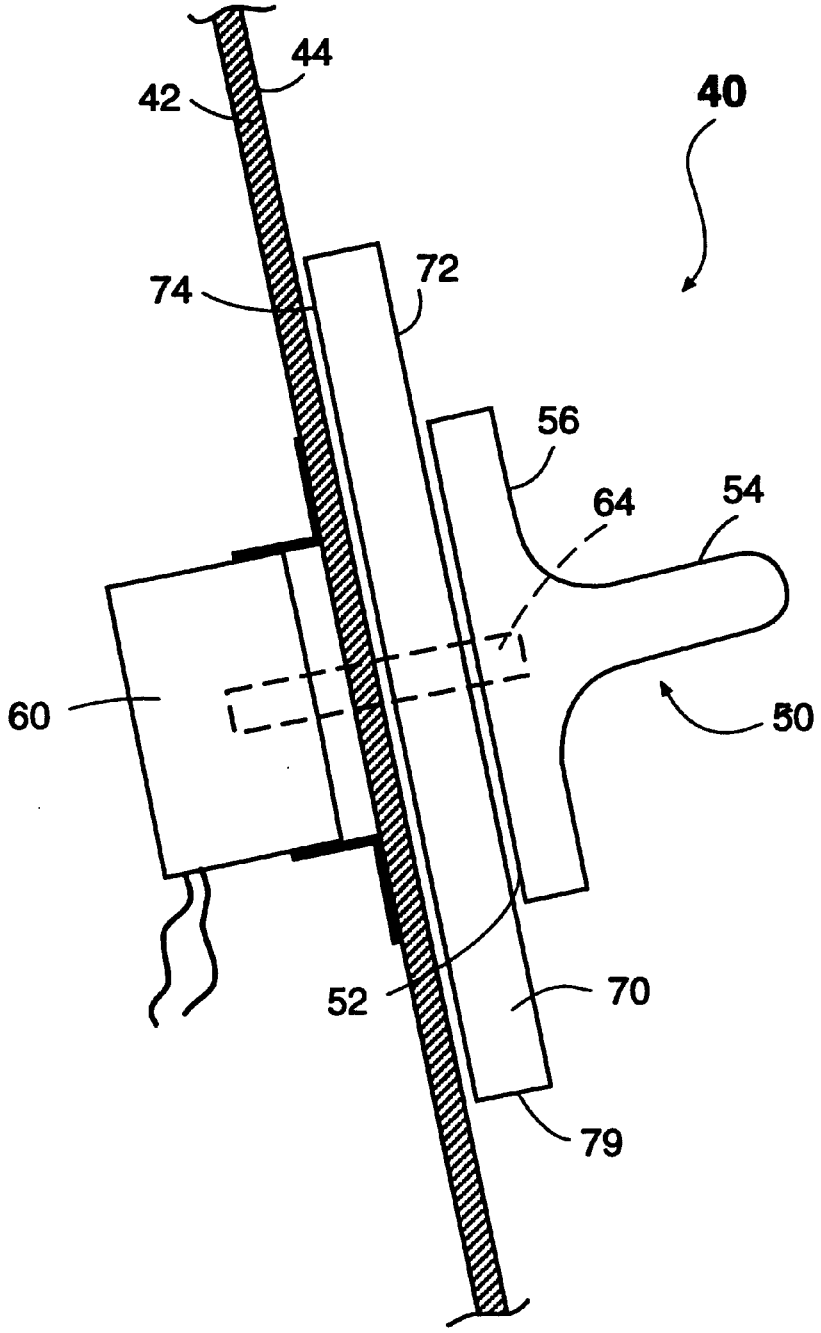
FIG. 4 is a side section view of one embodiment of the knob assembly of the present invention in the assembled, or "locked," position.

In its assembled, or locked, condition, the knob assembly 40 of the present invention is configured such that the interlock spacer 70 is disposed around the switch post 64 and between the rear face 52 of the control knob 50 and the panel face 44 of the control panel 42. See FIG. 4. This assembly may be accomplished by simply sliding the interlocking spacer 70 between the rear face 52 of the control knob 50 such that the switch post 64 travels through the slot 78 to the post hole 76. In this configuration, the interlock spacer 70 is supported by the switch post 64 and is preferably slidably engaged by both the panel face 44 and the rear face 52 of the control knob 50. In addition, there is preferably some static cling attraction generated between the panel face 44 and the bottom surface 74 of the interlock spacer 70 so as to discourage rotation of the interlock spacer 70 and otherwise provide additional support for the interlock spacer 70.

With the interlock spacer 70 disposed between the control knob 50 and the control panel 42, the interlock spacer 70 prevents the control knob 50 from being depressed sufficiently so as to be able to turn the associated switch post 64 and thereby activate the associated switch 60. Thus, the presence of the interlock spacer 70 between the control knob 50 and the control panel 42 prevents the associated cooking element 30 from being turned on. As such, it is necessary to remove the interlock spacer 70 before being able to activate the associated cooking elements 30 and thereby create dangerous situations. It is believed that when the interlock spacer 70 is made in its preferred transparent embodiment, young children will be unable to recognize the need to remove the interlock spacer 70 and, therefore, young children will be protected from such dangerous situations.

On the other hand, when an adult desires to use the stove 10, the interlock spacer 70 may be easily removed. Because the interlock spacer 70 is preferably of a larger diameter than the base portion 56 of the control knob 50, a portion of the interlock spacer 70 will extend out from behind the control knob 50. This portion may be engaged by an adult's fingers to push the interlock spacer 70 upwardly and out from between the control knob 50 and the control panel 42. Alternatively, the control knob 50 may be removed from the switch post 64, the interlock spacer 70 removed, and the control knob reattached to the switch post 64. The interlock spacer 70 may then be placed aside. Thereafter, the adult user is free to push in and turn the associated control knob 50 and activate the associated cooking element 30. When cooking is complete, the adult user may return the control knob 50 to its "off" position and reinsert or otherwise re-install the interlock spacer 70.

The discussion above has assumed that the interlock spacer 70 is of a round configuration. However, a round configuration is not necessary. Instead, the interlock spacer 70 may be of any suitable configuration, such as a square, star, octagon, or other polygon shape.

In addition, the interlock spacer 70 may be provided with suitable tabs (not shown) at one or more locations around the edge 79 extending generally normal from the interlock spacer 70 top surface 72. Such tabs may be helpful when trying to remove the interlock spacer 70. However, because such tabs may also facilitate the inadvertent removal by young children, the presence of such tabs is not desired.

In addition to stoves, the knob assembly of the present invention may also be used on other household appliances which may pose similar hazards to young children. For instance, the knob assembly may also be used with barbecue grills employing push-in-and-twist type controls.

The present invention provides a simple-to-use safety interlock which does not require the use of any bulky elements, or alteration to existing stoves 10, and which is simple to use. The knob assembly 40 described does not prevent access to the control knob's 50 surfaces. Rather, the knob assembly 40 relies on the interlock spacer 70 to prevent the depression of the control knob 50 from its "out" position to an "in" position. Because the control knob 50 is prevented from assuming its "in" position, the switch post 64 is prevented from turning, thereby inhibiting activation of the associated switch 60. Accordingly, the knob assembly 40 of the present invention is simple to manufacture, simple to use, and provides a safeguard against injury to young children.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A knob assembly for a cooking device, the cooking device having at least one cooking element and having at least one control panel having a panel face and at least one hole therethrough, comprising:

a) a switch for controlling at least one of the cooking elements;

b) a switch post coupled to said switch extending through the hole in the panel face and having an external end and moveable generally perpendicular to the panel face of the control panel between an in position and an out position; wherein the associated cooking element is not activated when said switch post is in said out position;

c) a control knob attached to said external end, said control knob having a rear face generally parallel to the panel face of the control panel; and d) an interlock spacer disposed between said rear face and the panel face of the control panel for preventing the movement of the switch post from the out position to the in position.

2. The knob assembly of claim 1 wherein said interlock spacer is generally round.

3. The knob assembly of claim 1 wherein said interlock spacer includes a post hole and wherein said switch post extends through said post hole.

4. The knob assembly of claim 3 wherein said interlock spacer further includes a generally radial slot connecting said post hole to the perimeter of said interlock spacer.

5. The knob assembly of claim 1 wherein said interlock spacer is generally transparent.

6. The knob assembly of claim 1 wherein said interlock spacer is generally planar and has a thickness in the range of approximately 0.1 inch to approximately 0.3 inch.

7. The knob assembly of claim 1 wherein said cooking device is an electric stove and wherein said control knob further includes a tongue portion extending generally perpendicular to the panel face of the control panel for gripping by a user.

8. The knob assembly of claim 2 wherein said control knob includes a generally round base portion having a first diameter and wherein said interlock spacer has a top surface and wherein said top surface has a dimension larger than said first diameter.

9. The knob assembly of claim 1 wherein:

a) the cooking device is a stove having a plurality of cooking elements;

b) said control knob has a generally round base portion having a first diameter;

c) said interlock spacer is generally transparent and has a perimeter, a post hole, and a generally radial slot connecting said post hole to said perimeter, the linear distance between at least two points on said perimeter being larger than said first diameter, said interlock spacer having a thickness in the range of approximately 0.1 inch to approximately 0.3 inch; and d) wherein said switch post extends through said post hole.

10. A stove, comprising a) a plurality of cooking elements;

b) at least one switch controlling at least one of said cooking elements;

c) a control panel having a panel face at least one hole therethrough;

d) a switch post coupled to said switch extending through said hole in said panel face and having an external end and moveable generally perpendicular to said panel face of said control panel between an in position and an out position; wherein said switch is not activated when said switch post is in said out position;

e) a control knob attached to said external end, said control knob having a rear face generally parallel to said panel face of said control panel; and f) an interlock spacer disposed between said rear face and said panel face of said control panel for preventing the movement of the switch post from the out position to the in position.

11. The stove of claim 10 wherein said interlock spacer is generally round.

12. The stove of claim 10 wherein said interlock spacer includes a post hole and wherein said switch post extends through said post hole.

13. The stove of claim 12 wherein said interlock spacer further includes a generally radial slot connecting said post hole to the perimeter of said interlock spacer.

14. The stove of claim 10 wherein said interlock spacer is generally transparent.

15. In a cooking device having a control panel having a panel face and having at least one cooking element and an associated switch, said switch having a switch post moveable generally perpendicular to the panel face between an in position and an out position; wherein the associated cooking element is not activated when said switch post is in said out position, and having a control knob attached to said switch post, a method of safety interlocking comprising:

a) positioning a interlock spacer between said control knob and said panel face so as to prevent the movement of the switch post from the out position to the in position and thereby prevent the switch from being activated.

16. The method of claim 15 wherein said control knob has a rear face generally parallel to the panel face and wherein said positioning includes inserting the interlock spacer between said rear face and said panel face.

17. The method of claim 15 wherein said interlock spacer has a perimeter and includes a central post hole and a generally radial slot connecting said post hole to said perimeter and further including supporting said interlock spacer with said switch post.

18. The method of claim 15 wherein said interlock spacer is generally transparent.

19. An interlock spacer for a cooking device having a control panel and having at least one push-in-and-turn type control knob for controlling an associated cooking element and moveable between an in position and an out position, wherein the associated cooking element is not activated when the control knob is in the out position, comprising:

a) a main body having a perimeter edge and having a thickness in the range of approximately 0.1 inch to approximately 0.3 inch and having a generally planar top surface and a generally planar bottom surface;

b) a centrally located post hole extending through said main body and adapted to accept a switch post associated with the control knob therethrough;

c) a generally radial slot running from said post hole to said edge;

d) said interlock spacer adapted for insertion between a panel face of the control panel and the control knob so as to prevent the movement of the control knob from the out position to the in position and thereby prevent the cooking element from being activated.

20. The interlock spacer of claim 19 wherein said main body is generally transparent.

21. A knob assembly for a cooking device, the cooking device having at least one cooking element and having at least one control panel having a panel face and at least one hole therethrough, comprising:

a) a switch for controlling at least one of the cooking elements;

b) a switch post coupled to said switch extending through the hole in the panel face and having an external end and moveable generally perpendicular to the panel face of the control panel between an in position and an out position; wherein the associated cooking element is not activated when said switch post is in said out position;

c) a control knob attached to said external end, said control knob having a rear face generally parallel to the panel face of the control panel; and d) a single-piece interlock spacer disposed between said rear face and the panel face of the control panel for preventing the movement of the switch post from the out position to the in position.

22. A stove, comprising a) a plurality of cooking elements;

b) at least one switch controlling at least one of said cooking elements;

c) a control panel having a panel face at least one hole therethrough;

d) a switch post coupled to said switch extending through said hole in said panel face and having an external end and moveable generally perpendicular to said panel face of said control panel between an in position and an out position; wherein said switch is not activated when said switch post is in said out position;

e) a control knob attached to said external end, said control knob having a rear face generally parallel to said panel face of said control panel; and f) a single-piece interlock spacer disposed between said rear face and said panel face of said control panel for preventing the movement of the switch post from the out position to the in position.

23. In a cooking device having a control panel having a panel face and having at least one cooking element and an associated switch, said switch having a switch post moveable generally perpendicular to the panel face between an in position and an out position; wherein the associated cooking element is not activated when said switch post is in said out position, and having a control knob attached to said switch post, a method of safety interlocking comprising:

a) positioning a single-piece interlock spacer between said control knob and said panel face so as to prevent the movement of the switch post from the out position to the in position and thereby prevent the switch from being activated.

* * * * *